United States Patent [19]

Lown et al.

[11] 3,951,086

[45] Apr. 20, 1976

[54] FLOATING SUPPORT STRUCTURE

[75] Inventors: Eldon C. Lown, Munroe Falls; Alanson D. Topping, Akron, both of Ohio

[73] Assignee: The United States of America as represented by the Secretary of the Navy, Washington, D.C.

[22] Filed: May 31, 1973

[21] Appl. No.: 365,822

[52] U.S. Cl. ..... 114/.5 D; 114/.5 F

[51] Int. Cl.[2] ..... B63B 35/44

[58] Field of Search ..... 114/.5 F, .5 D, 43.5; 61/46.5; 9/2 A, 8 R

[56] References Cited

UNITED STATES PATENTS

| | | | |
|---|---|---|---|
| 1,549,790 | 8/1925 | Neusella | 46/87 |
| 2,370,069 | 2/1945 | Patten | 9/2 A |
| 3,278,938 | 10/1966 | Rosenthal | 343/880 |
| 3,390,408 | 7/1968 | Lockwood et al. | 9/8 R |
| 3,484,788 | 12/1969 | Bell et al. | 343/880 |
| 3,771,484 | 11/1973 | Schott et al. | 114/43.5 |

*Primary Examiner*—Trygve M. Blix
*Assistant Examiner*—Stuart M. Goldstein
*Attorney, Agent, or Firm*—R. Sciascia; R. Beers; S. Scheinbein

[57] ABSTRACT

A floating support structure includes a deck having a plurality of columns rigidly affixed thereto. Each column is composed of a fabric covered by a flexible sealant material. Each column has an upper, central, and lower portion. The upper and lower portions are hollow. The upper portion is inflated with air, and the lower portion is filled with a material equivalent to or greater than the weight of the surrounding water. The central portion has a reduced cross-section and connects the upper and lower portion of the column in a manner that allows a degree of universal relative motion between the upper and lower portion of the column. A single column of the type described could be used to attenuate the motion of a spar buoy.

7 Claims, 1 Drawing Figure

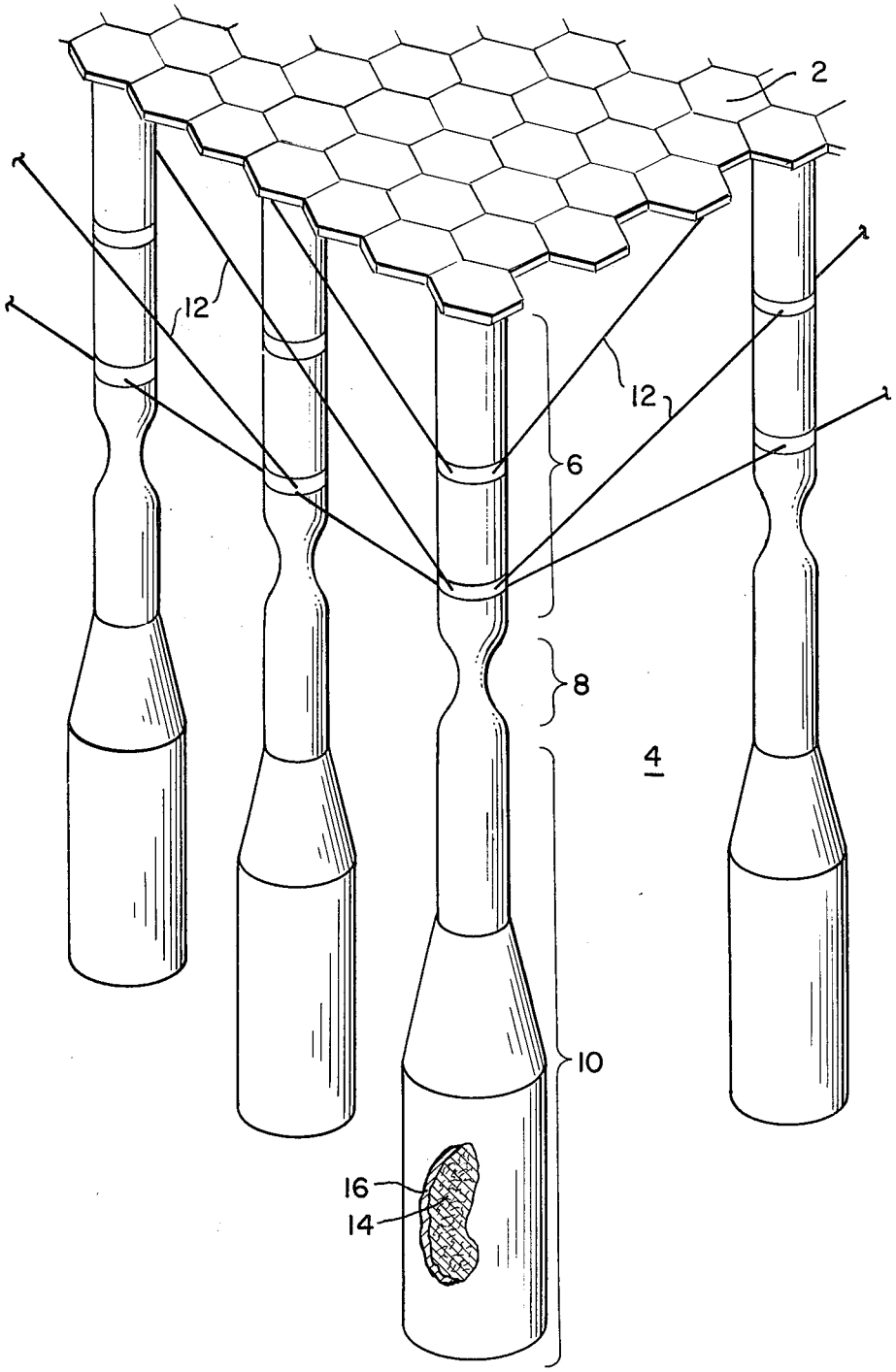
2
12
12
6
8
4
10
16
14

FLOATING SUPPORT STRUCTURE

BACKGROUND OF THE INVENTION

The present invention relates generally to support structures and more particularly to floating support structures or platforms. Various efforts have been made in the past to attenuate the motion of floating platforms caused by waves. Waves exert both horizontal and vertical forces on the platforms. Others have found that extension of the floats supporting the platform to depths below the water surface level attentuates the vertical forces exerted by the passing waves. The extension of the supporting members below the water surface, however, increases the moment arm and resulting horizontal forces applied to the platform through the supporting members.

SUMMARY OF THE INVENTION

The present invention attenuates the vertical forces exerted on a platform or spar buoy due to passing waves by extendiing the supporting column or columns below the water surface level and minimizes the resulting bending moment by providing for a degree of universal relative movement between the upper and lower portions of the supporting columns.

An object of the present invention is to maintain a floating platform in a substantially level position regardless of the roughness of the water in which it is located.

Another object is to attenuate the effect on the platform of the bending moment exerted on the lower portion of the platform support structures.

Other objects, advantages, and novel features of the present invention will become apparent from the following detailed description of the invention when considered in conjunction with the accompanying drawing.

BRIEF DESCRIPTION OF THE DRAWINGS

The FIGURE is a view in perspective of a floating platform employing the novel columns of the present invention.

DESCRIPTION OF THE PREFERRED EMBODIMENT

The FIGURE illustrates a platform 2 supported by a plurality of columns 4. Each column 4 is a unitary, hollow, generally tubular-shaped structure having three integral portions, an upper portion 6, central portion 8 and lower portion 10. The columns are made of woven fabric 14 sealed with a flexible sealant 16 such as rubber or neoprene. Other sealant materials may be employed as long as they are flexible and render the fabric substantially impermeable to the passage of fluid therethrough.

Lower portion 10 is either completely or partially filled with water through a valve (not shown). Upper portion 6 which communicates with lower portion 10 through central portion 8 is inflated with air through a valve (not shown) to a sufficient pressure to prevent sagging of the column 4. Sagging is undesirable, especially in the lower portion 10, since it reduces the vertical force attenuation efficiency of the column 4.

The central portion 8 of the column 4 has a reduced cross-section which may be in the form of an hourglass shape as shown in the drawing. This reduced cross-section of central portion 8 permits a degree of universal relative motion of the lower portion about the vertical axis of upper portion 6. The central portion 8 may be reinforced by adhesively bonding thereto an additional layer or layers of sealed fabric.

Preferably, the upper hollow portion 6 forms the buoyant part of the column 4 and the lower portion 10 is filled with a material to make it heavier than the surrounding water and primarily serves to attenuate vertical forces. The reduced cross-section at the central portion 8 prevents bending moments applied to the lower portion 10 from reaching the platform 2. Air and water are preferable filler materials for the upper and lower portions respectively; however, any buoyant material may be employed in upper portion 6 and any material having a specific gravity equal to or greater than water may be employed in lower portion 10. The lower portion must be totally rigid to operate most efficiently in attenuating vertical forces and, as shown in the drawing, preferably has a cross-section greater than either the upper or central portion.

The upper portion 6 is rigidly affixed to the platform 2. This affixation may be accomplished by first adhesively bonding the fabric column to a plate and then welding the plate to the platform or bolting it to the platform. Any other suitable attachment may be employed, however. Cables 12 are part of a truss system for stabilizing the position of the upper portions 6 of the plurality of columns 4 with respect to each other and to the platform 2.

Obviously many modifications and variations of the present invention are possible in light of the above teachings. It is therefore to be understood that, within the scope of the appended claims, the invention may be practiced otherwise than as specifically described.

What is claimed is:

1. A floating, vertical support structure for a substantially horizontal platform comprising at least one unitary inflatable column having hollow upper, central and lower portions, the platform being supported at the upper end of said column, said central portion having a cross-section appreciably smaller than said upper and lower portions for permitting relative motion between said uper and lower portions thereby minimizing the transmission of bending moments therebetween.

2. The support structure of claim 1 wherein said column is made of fabric sealed with a flexible sealant to be substantially impermeable to the passage of fluid through the fabric.

3. The support structure of claim 1 wherein said central portion communicates with said upper and lower poritons.

4. The support structure of claim 3 wherein said lower portion has a cross-section appreciably greater than said upper portion.

5. The support structure of claim 1 wherein said central portion is shaped in the form of an hourglass.

6. A floating support structure comprising at least one hollow inflatable fabric column sealed with a flexible sealant to be substantially impermeable to the passage of fluid through the fabric, said column having upper, central and lower portions, said central portion communicating with said upper and lower portions and having a cross-section appreciably smaller than said upper and lower portions for permitting relative motion between said upper and lower portions, said lower portion having a cross-section appreciably greater than said upper portion, said upper portion being inflated with air to a predetermined pressure, and said lower portion being filled with water to a predetermined level.

7. A floating support structure comprising a platform, a plurality of hollow inflatable fabric columns sealed with a flexible sealant to be substantially impermeable to the passage of fluid through the fabric, the top of said columns rigidly affixed to one side of said platform, each of said columns having upper, central and lower portions, said central portion communicating with said upper and lower portion and having a cross-section appreciably smaller than said upper and lower portions for permitting relative motion between said upper and lower portions, said lower portion having a cross-section appreciably greater than said upper portion, said upper portion being inflated with air to a predetermined pressure, and said lower portion being filled with water to a predetermined level.

* * * * *